US012290154B2

(12) United States Patent
Wilson et al.

(10) Patent No.: US 12,290,154 B2
(45) Date of Patent: May 6, 2025

(54) CARRY BAG WITH SLIDING CUT-OUT PANEL

(71) Applicant: Funko, LLC, Everett, WA (US)

(72) Inventors: Laci Marie Wilson, Los Angeles, CA (US); Elisabeth DeSilva, Diamond Bar, CA (US); Monique Herrera, Santa Clarita, CA (US); Domonique Janae Battle, Inglewood, CA (US); Desiree Navarro-Silverman, Los Angeles, CA (US)

(73) Assignee: FUNKO, LLC, Everett, WA (US)

( * ) Notice: Subject to any disclaimer, the term of this patent is extended or adjusted under 35 U.S.C. 154(b) by 116 days.

(21) Appl. No.: 18/185,686

(22) Filed: Mar. 17, 2023

(65) Prior Publication Data

US 2023/0292899 A1 Sep. 21, 2023

Related U.S. Application Data

(60) Provisional application No. 63/321,003, filed on Mar. 17, 2022.

(51) Int. Cl.
*A45C 13/08* (2006.01)
*A45C 13/00* (2006.01)

(52) U.S. Cl.
CPC ..... *A45C 13/08* (2013.01); *A45C 13/001* (2013.01)

(58) Field of Classification Search
CPC . A45C 13/08; A45C 13/001; A45F 2003/001; A45F 3/04
USPC ..... 150/103
See application file for complete search history.

(56) References Cited

U.S. PATENT DOCUMENTS 1,638,594 A 8/1927 Myers
2,628,452 A * 2/1953 Gladstein ..... A63H 3/52 446/28
3,789,546 A * 2/1974 Morrison ..... A47G 9/1045 446/268

(Continued)

FOREIGN PATENT DOCUMENTS

CN 201036380 Y 3/2008

OTHER PUBLICATIONS

Leisure Arts Paper Dolls: https://www.amazon.com/LEISURE-ARTS-LA-6076-Paper-Dolls/dp/B00CH9RPZA (Year: 2011).*

(Continued)

*Primary Examiner* — Don M Anderson
*Assistant Examiner* — Justin Caudill
(74) *Attorney, Agent, or Firm* — LaMorte & Associates P.C.

(57) ABSTRACT

A carry bag is provided that has exterior surfaces. A cut-out panel is provided that is configured with a character with a theme that is shared by graphics used on the exterior surfaces of the carry bag. A mounting system is used to join the cut-out panel to the carry bag or to a pocket extension on the carry bag. The mounting system enables the cut-out panel to move through a range of motion relative to the carry bag while remaining attached to the carry bag. At least some of the cut-out panel covers at least some of the exterior surfaces of the carry bag at some positions within its range of motion. In this manner, at least some of the cut-out panel is visible on the exterior of the carry bag and the position of the cut-out panel can be selectively altered by the user.

13 Claims, 8 Drawing Sheets

(56) References Cited

U.S. PATENT DOCUMENTS

| | | | | |
|---|---|---|---|---|
| 4,975,987 | A | 12/1990 | Teachout et al. | |
| 5,197,525 | A | 3/1993 | Cantor | |
| 5,332,093 | A * | 7/1994 | Littlepage | A45C 9/00 446/268 |
| 5,803,331 | A | 9/1998 | Thorne et al. | |
| 5,901,372 | A | 5/1999 | Lawler | |
| 5,975,392 | A * | 11/1999 | Miller | A45F 3/04 224/901.2 |
| 6,510,974 | B2 | 1/2003 | Willingham et al. | |
| 7,028,870 | B2 * | 4/2006 | Valdez-Campbell | A45C 7/0095 224/684 |
| 8,926,392 | B2 | 1/2015 | Strong | |
| 10,421,024 | B2 * | 9/2019 | Stewart | B60L 15/20 |
| 2005/0279794 | A1 * | 12/2005 | Gerchen | A45F 3/042 224/576 |
| 2006/0027292 | A1 | 2/2006 | Persic | |
| 2010/0218862 | A1 | 9/2010 | Ellermeyer | |
| 2010/0252152 | A1 | 10/2010 | Stupski | |
| 2010/0325781 | A1 | 12/2010 | Lopes | |
| 2012/0241059 | A1 | 9/2012 | Wilson | |
| 2013/0306206 | A1 | 11/2013 | Quinnan | |

OTHER PUBLICATIONS

Educational Insights Paper Dolls: https://www.amazon.com/Educational-Insights-PaperCraft-Boutique-Fashion/dp/B08WJJPR52 (Year: 2021).*

* cited by examiner

CARRY BAG WITH SLIDING CUT-OUT PANEL

RELATED APPLICATIONS

The present invention claims the benefit of U.S. Provisional Application No. 63/321,003, filed Mar. 17, 2022.

BACKGROUND OF THE INVENTION

1. Field of the Invention

In general, the present invention relates to the structure of carry bags, such as backpacks, book bags, handbags, and the like. More particularly, the present invention relates to the structure of carry bags that have movable decorative features that are applied to the carry bags or are integrated into the structure of the carry bags.

2. Prior Art Description

In the prior art, there are many different types of carry bags, in the form of book bags, backpacks, handbags, belt bags and the like. Such bags are often designed to be purely functional. However, such bags are typically stylized and decorated in order to be both fashionable and functional. Some carry bags are stylized and decorated with a particular theme. That is, the carry bags are designed with a theme of a character, show, movie, or company. This is especially prevalent when a carry bag is designed for the children or young adult marketplace. Carry bags can be themed by applying graphics to the exterior of the bag. However, a more interesting method of adding a theme to a carry bag is to integrate a character or themed feature into the physical structure of the bag. That is, make the carry bag look like a character or themed object. Alternatively, a character or themed object can be attached to the exterior of the bag in a predominant location.

In U.S. Pat. No. 1,638,594 to Myers, a bag is integrated into the structure of a plush character. Accordingly, the carry bag looks like a plush character and does not look like a carry bag. In U.S. Pat. No. 8,926,392 to Strong, features of a character, such as a head and arms, are attached to a carry bag. The problem with such themed carry bags is that the character and other themed features are fixed in prominent positions. The character and themed features cannot be moved. Accordingly, the prominence of the character and/or themed features cannot be altered. As such, a themed bag that is otherwise stylish for a wide range of ages, may only appeal to the youngest consumers and may be considered childish by slightly older consumers.

The present invention is a themed carry bag, where the prominence of a character and/or themed feature can be selectively controlled. In this manner, a themed character can be made highly visible, slightly visible or hidden. In this manner, the themed nature of the carry bag can be selectively adjusted to the circumstances and fashion sense of the user. This enables the themed carry bag to appeal to a much larger consumer base. Furthermore, since the character and/or themed features are adjustable in position, the themed carry bag now has play value. This makes the themed carry bag more appealing to young consumers and to the parents of young consumers. This invention is described and claimed below.

SUMMARY OF THE INVENTION

The present invention is a carry bag having exterior surfaces. A cut-out panel is provided that has a front surface and a rear surface. The cut-out panel can be configured with a character with a theme that is shared by graphics used on the exterior surfaces of the carry bag.

A mounting system is used to join the cut-out panel to the carry bag or to a pocket extension on the carry bag. The mounting system enables the cut-out panel to move through a range of motion relative to the carry bag while remaining attached to the carry bag. At least some of the cut-out panel covers at least some of the exterior of the carry bag at some positions within its range of motion. In this manner, at least some of the cut-out panel is visible on the exterior of the carry bag and the position of the cut-out panel can be selectively altered by the user.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention assembly can be embodied in many ways, only a few exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered limitations when interpreting the scope of the claims.

Figure 1:
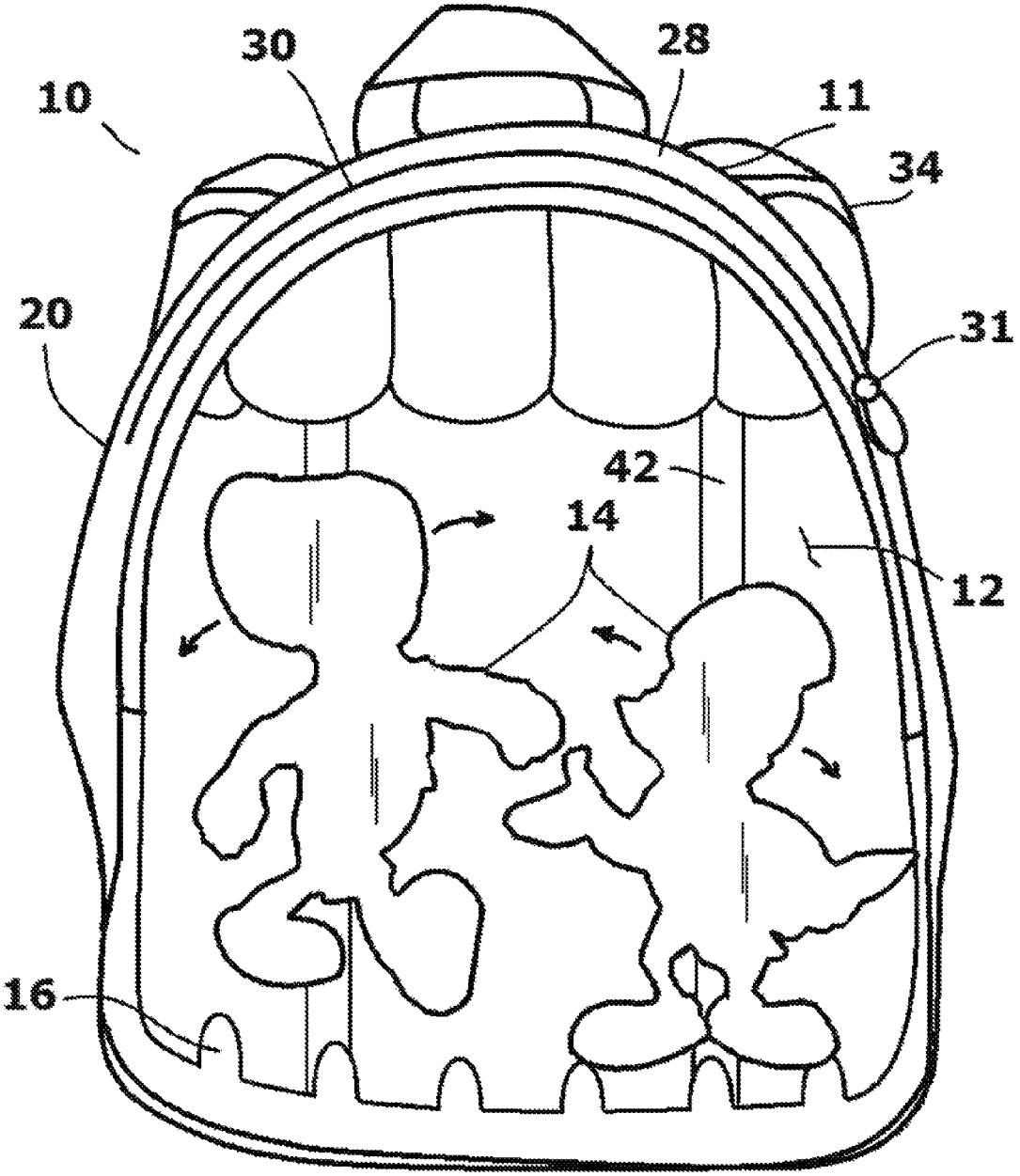
FIG. 1 shows a first exemplary embodiment of a backpack assembly in accordance with the present invention.
Figure 2:
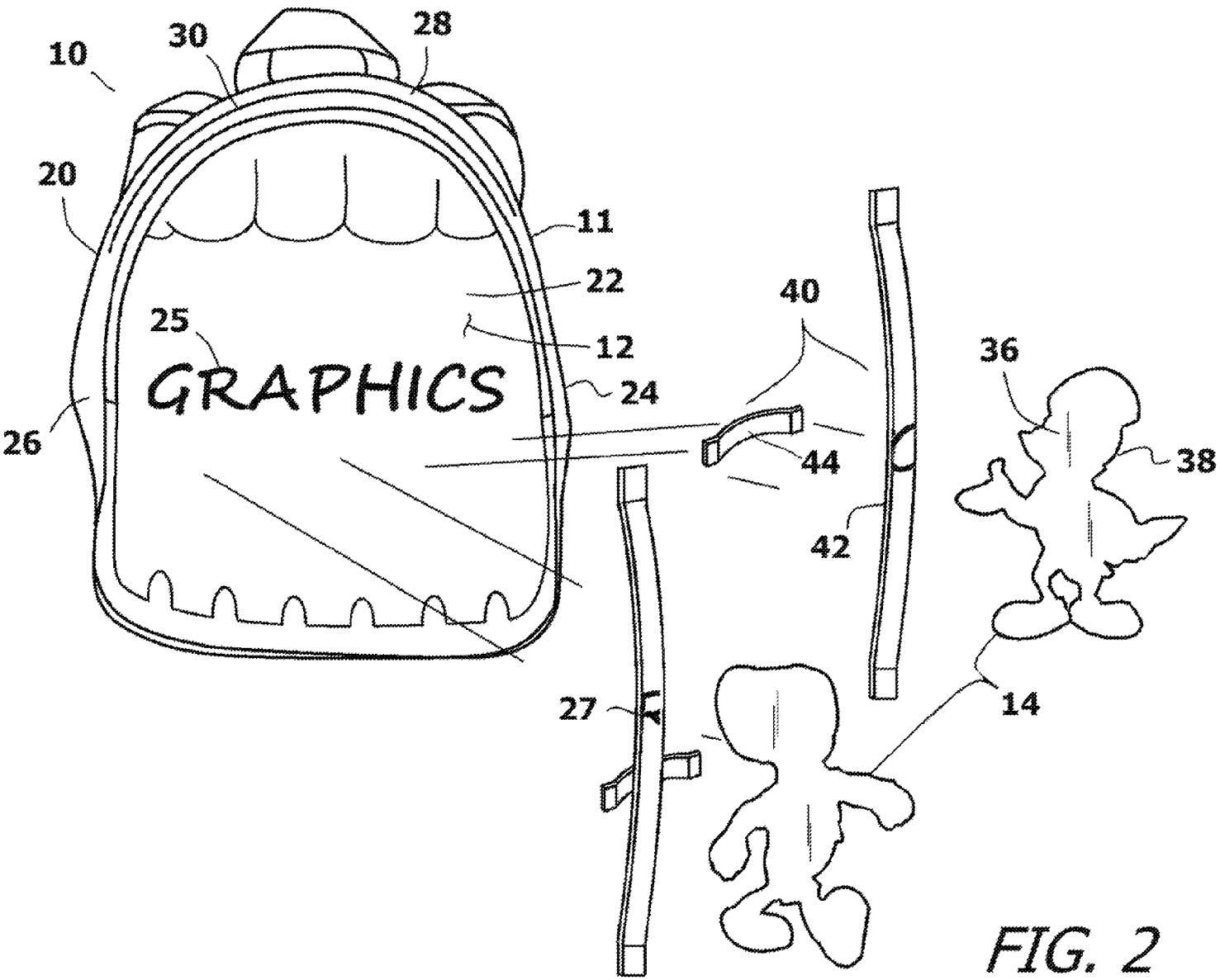
FIG. 2 is an exploded view of the first exemplary embodiment of FIG. 1.

Referring to FIG. 1 and FIG. 2, a carry bag assembly is illustrated. In this embodiment, the carry bag assembly 10 is shown as a backpack 11. However, the backpack 11 should be considered only an example of any carry bag, such as a shoulder bag, handbag, belt bag or the like. The carry bag assembly 10 has exterior surfaces 12 that may contain graphics 25, decorations 16, and/or other features in a particular theme. As will be explained, the carry bag assembly 10 also contains one or more movable cut-out panels 14 that are shaped and decorated as a character or themed object. The character and/or themed object is associated with the selected overall theme for the carry bag assembly 10.

Because the carry bag assembly 10 illustrated is shaped as a backpack 11. The carry bag assembly 10 has a main bag 20 that defines a large internal compartment. The main bag 20 has a front surface 22, a rear surface 24 and peripheral surfaces 26 that join the front surface 22 to the rear surface 24. The peripheral surfaces 26 include a top section 28. The top section 28 has an access opening 30 with a zippered closure 31 for selectively accessing the large internal compartment.

Shoulder straps 34 are attached to the rear surface 24 of the main bag 20. In this manner, the rear surface 24 of the main bag 20 will lay against a wearer's back when the shoulder straps 34 are used to wear the carry bag assembly 10. The front surface 22 is exposed and faces away from the wearer. Accordingly, the graphics 25 and decorations 16 on the front surface 22 are highly visible.

At least one cut-out panel 14 is provided. Each cut-out panel 14 has a front surface 36 and a rear surface 38. The cut-out panel 14 is shaped as a character or object and shares the same theme as the front surface 26 of the backpack 11. In the shown example, two cut-out panels 14 are used. The cut-out panels 14 show characters from an animated film. The front surface 22 of the backpack 11 is decorated with graphics 25 as a scene from that film. The cut-out characters 14 are mounted to the front surface 22 of the backpack 11 in a manner that enables the cut-out characters 14 to move both vertically and horizontally within a given range of movement.

Figure 3:
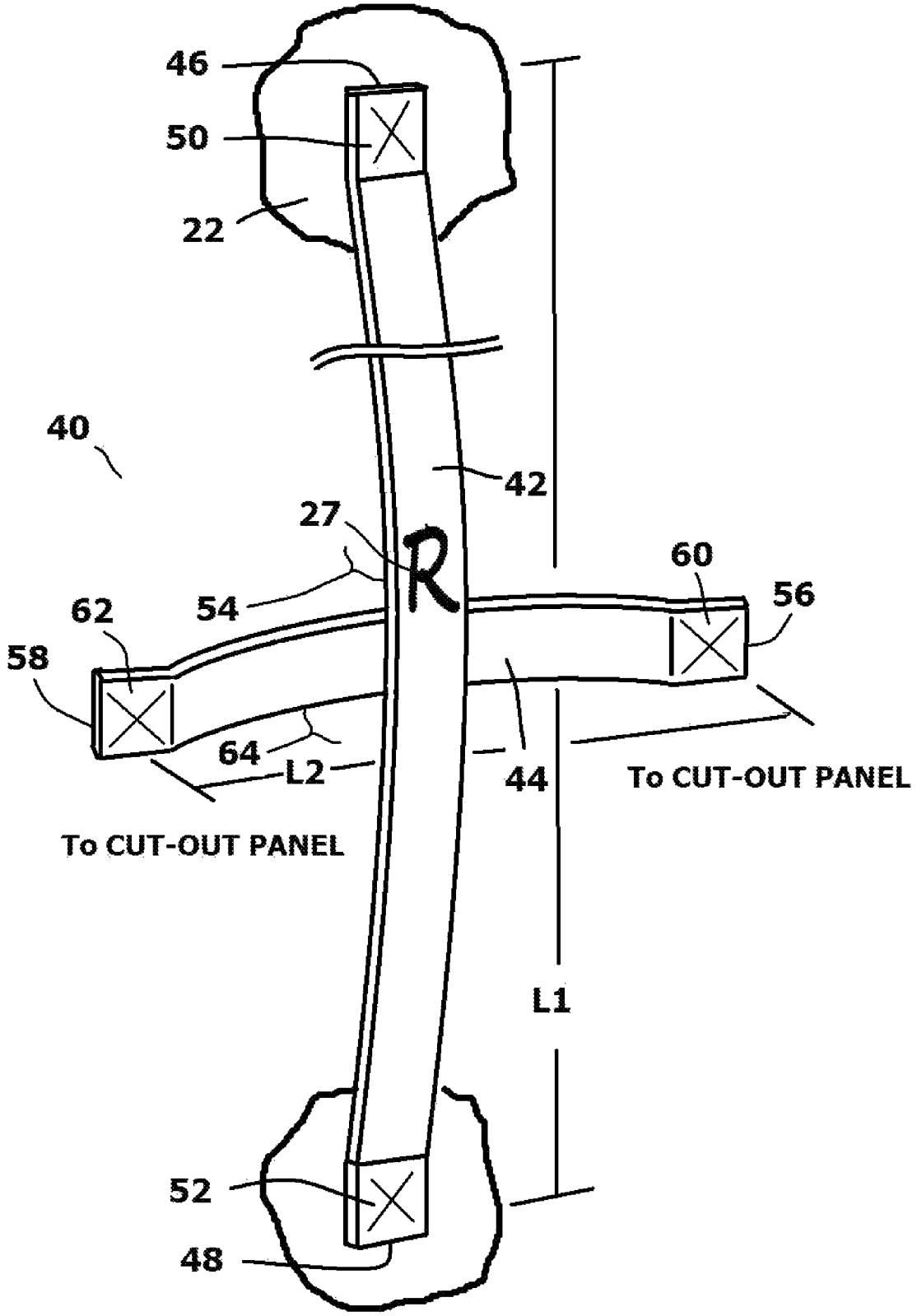
FIG. 3 is an enlarged view of the slide connector used in the first exemplary embodiment of FIG. 1.

Referring to FIG. 3 in conjunction with FIG. 2 and FIG. 1, it can be seen that a mounting system 40 is used for mounting each of the cut-out panels 14 to the front surface 22 of the main bag 20. The mounting system 40 utilizes two interloped straps 42, 44. A first strap 42 is provided that attaches to the front surface 22 of the backpack 11. The first strap 42 is long and is visible above and/or below the cut-out panels 14. Accordingly, the first strap 42 contains secondary graphics 27 that match or complement the graphics 25 on the front surface 22 of the backpack 11. In this manner, the first strap 42 becomes camouflaged atop the front surface 22 of the backpack 11. In this manner, the presence of the first strap 42 is hard to visually detect.

The first strap 42 has a first end 46 and an opposite second end 48. A first section 50 of the first strap 42 near the first end 46 is sewn to the front surface 22 of the backpack 11. Likewise, a second section 52 of the first strap 42 near the second end 48 is sewn to the front surface 22 of the backpack 11. The first strap 42 spans an open area between the first section 50 and the second section 52 where the first strap 42 is separated from the front surface 22 of the backpack 11. This forms a first loop 54 of length L1 between the first strap 42 and the front surface 22 of the backpack 11.

The second strap 44 attaches to the rear surface 38 of the cut-out panel 14. The second strap 44 has a first end 56 and an opposite second end 58. A first section 60 of the second strap 44 near the first end 56 is sewn to the rear surface 38 of the cut-out panel 14. Likewise, a second section 62 of the second strap 44 near the second end 58 is sewn to the rear surface 38 of the cut-out panel 14. The second strap 44 spans an open area between the first section 60 and the second section 62 where the second strap 44 is separated from the rear surface 38 of the cut-out panel 14. This forms a second loop 64 of length L2 between the second strap 44 and the rear surface 38 of the cut-out panel 14.

The first loop 54 and the second loop 64 are interlinked. Furthermore, the first strap 42 forming the first loop 54 is oriented generally perpendicular to the second strap 44 forming the second loop 64. As a consequence, the first loop 54 and the second loop 64 are connected together like links in a chain, wherein each is free to move independently. The first loop 54 can move up and down, and back and forth, within the confines of the second loop 64. The second loop 64 can move up and down, and back and forth, within the confines of the first loop 54. The range of movement is only limited by the length L1 of the first loop 54, the length L2 of the second loop 64, the width of the first loop 54, and the width of the second loop 64. Since the first loop 54 is anchored to the cut-out panel 14 and the second loop 64 is anchored to the backpack 11, the cut-out panel 14 can be selectively moved relative to the backpack 11 while remaining connected to the backpack 11. The result is that the position of each cut-out panel 14 can be altered. A user can therefore position each cut-out panel 14 in any desired position within its range of movement. Once a cut-out panel 14 is manipulated into a desired position, friction between the interlinked loops 54, 64 holds each of the cut-out panels 14 in place.

Figure 4:
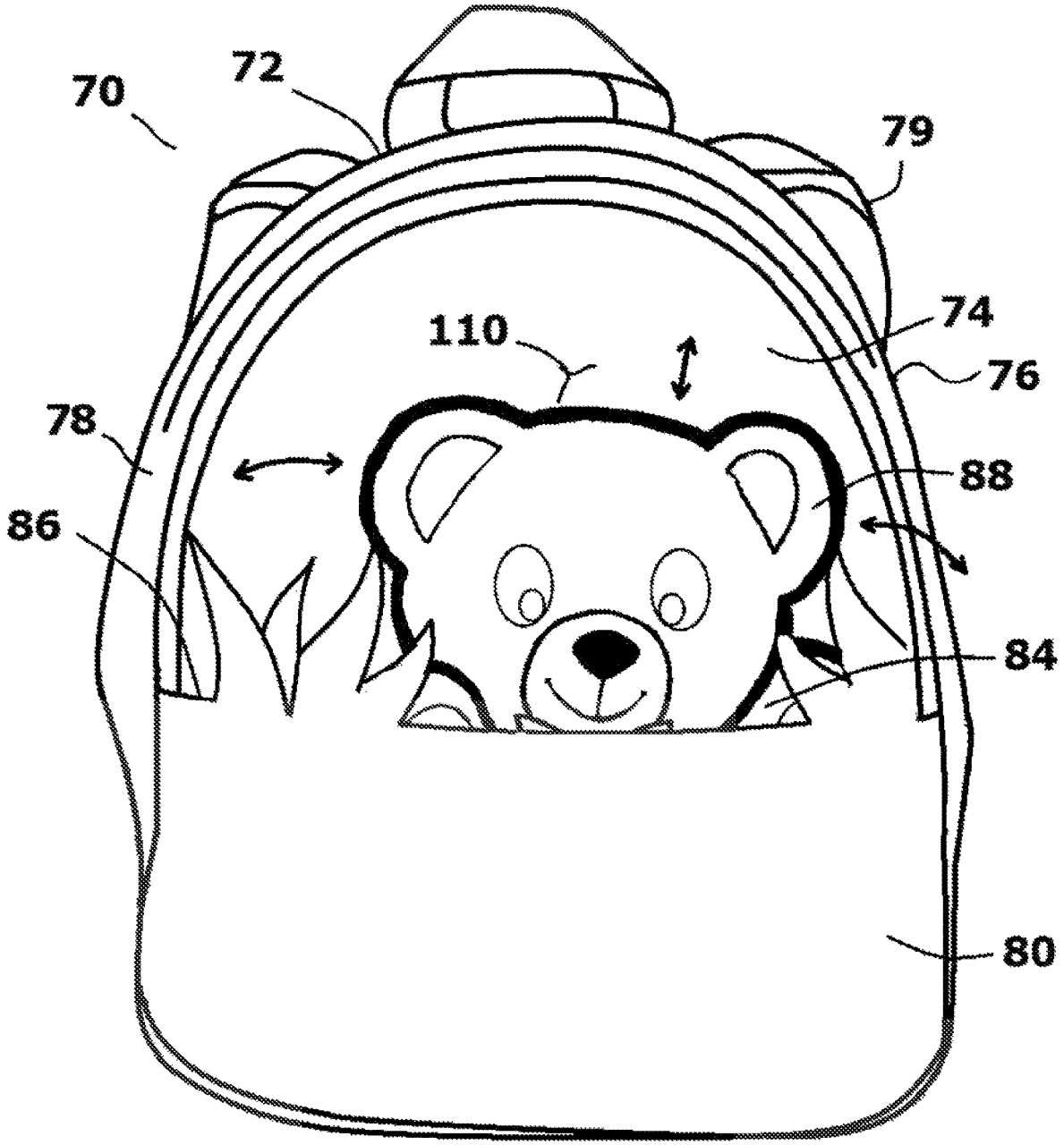
FIG. 4 shows a second exemplary embodiment of a backpack assembly in accordance with the present invention.
Figure 5:
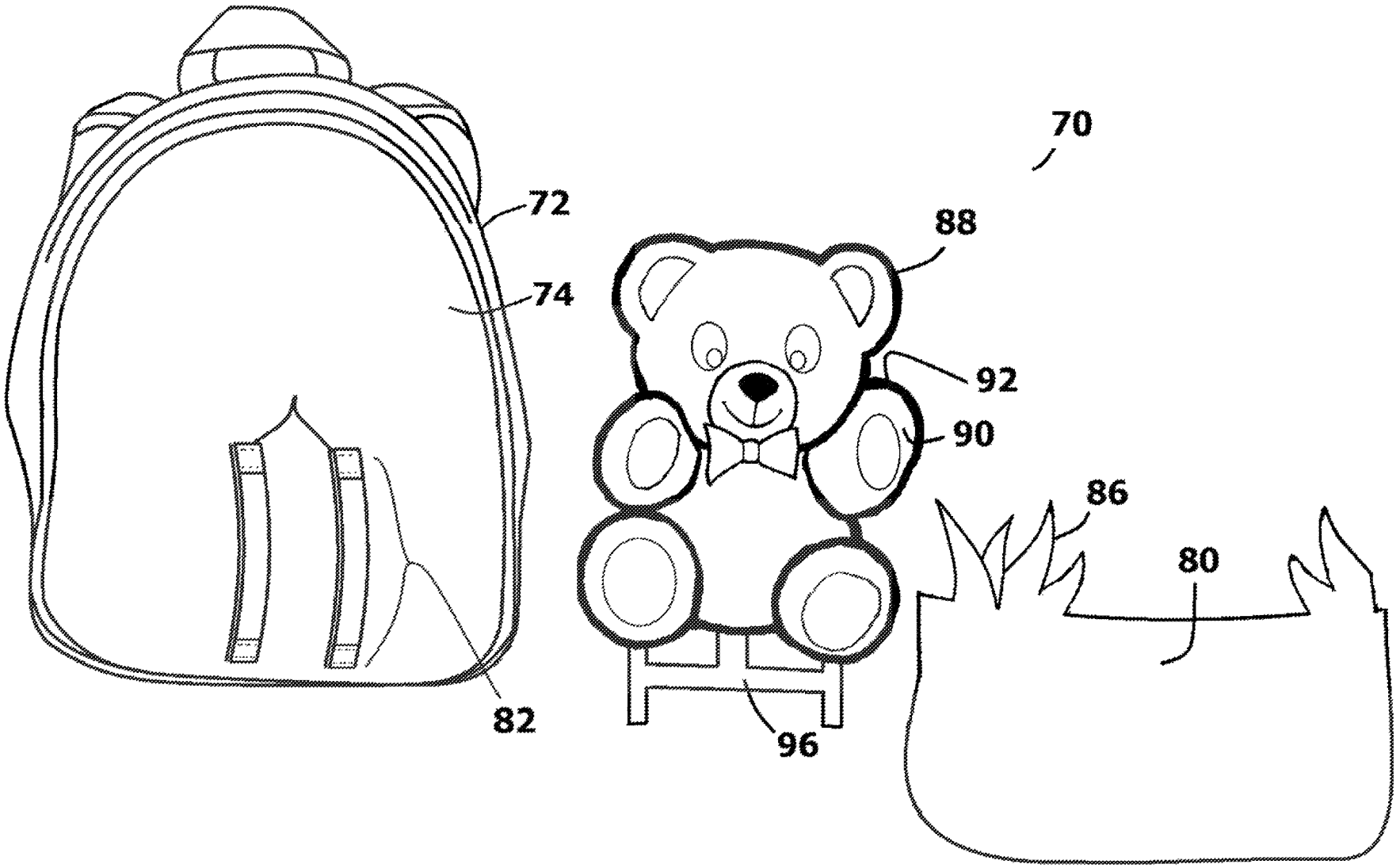
FIG. 5 is an exploded view of the second exemplary embodiment of FIG. 4.

Referring to FIG. 4 and FIG. 5, an alternate embodiment of a carry bag assembly 70 is shown. The carry bag assembly 70 has a main bag 72. The main bag 72 has a front surface 74, a rear surface 76 and peripheral surfaces 78 that join the front surface 74 to the rear surface 76. Shoulder straps 79 are attached to the rear surface 76 of the main bag 72. In this manner, the rear surface 76 of the main bag 72 will lay against a wearer's back when the shoulder straps 79 are used to wear the carry bag assembly 70.

A pocket extension 80 is provided on the front surface 74 of the main bag 72. The pocket extension 80 encloses a protected area 82 on the front surface 74. The pocket extension 80 is highly visible on the front surface 74 of the main bag 72 and is themed in a complementary manner with the main bag 72. The pocket extension 80 has an open top 84 and a top rim 86 that can be selectively shaped to match the selected theme.

A cut-out panel 88 is provided. The cut-out panel 88 has a front surface 90 and a rear surface 92. The cut-out panel 88 is shaped as a character or object. In the shown example, the cut-out panel 88 is shaped as a bear. Furthermore, at least the front surface 90 of the cut-out panel 88 is decorated as the character. The rear surface 92 of the cut-out panel 88 is attached to an internal surface of the pocket extension 80 within the protected area 82. As will be explained, the cut-out panel 88 is attached to an internal surface of the pocket extension 80 with a slide connection mounting system that enables the cut-out panel 88 to slide up and down and back and forth within the pocket extension 80 while remaining affixed to the main bag 72.

Figure 6:
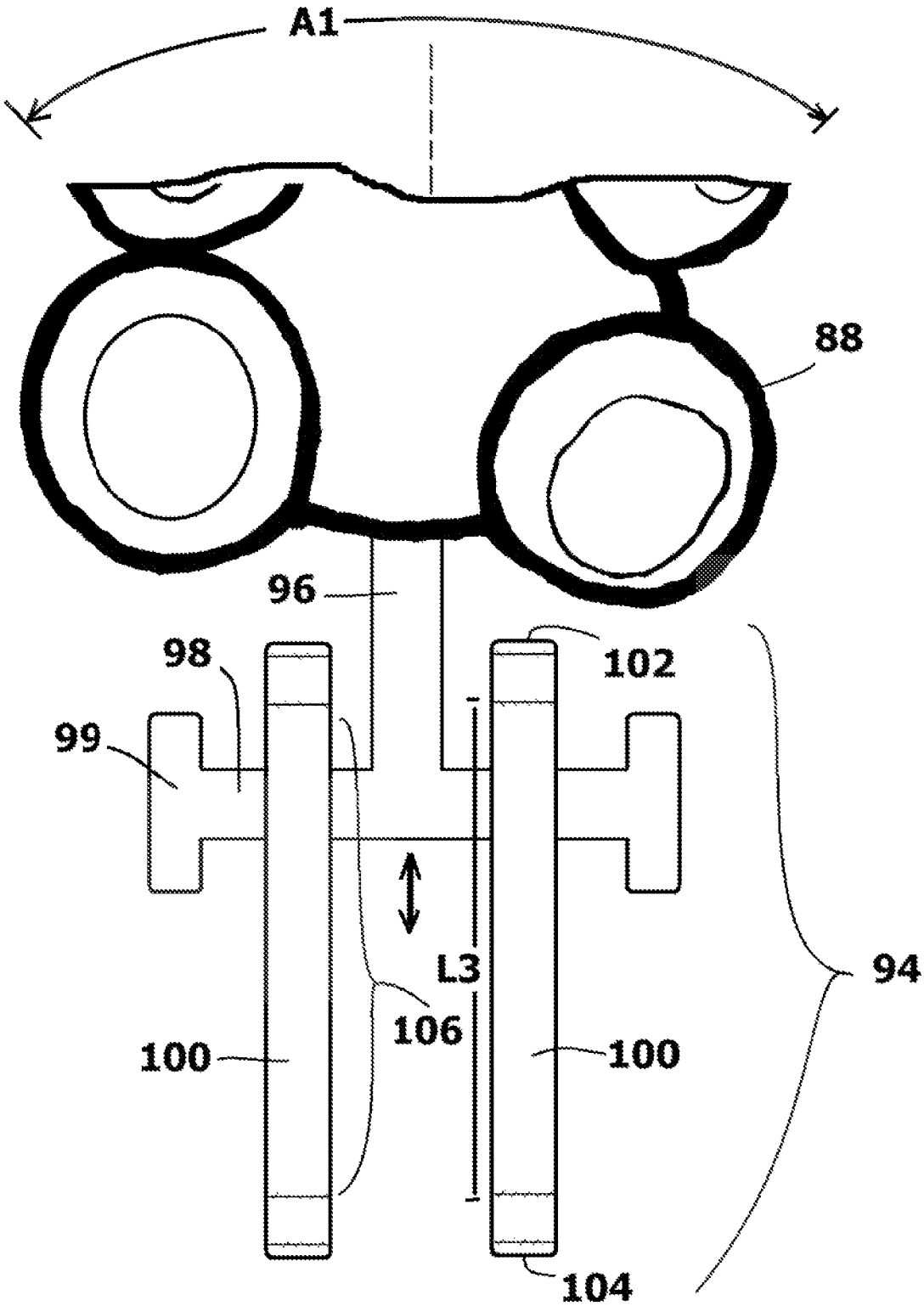
FIG. 6 is an enlarged view of the slide connector used in the exemplary embodiment of FIG. 4.

Referring to FIG. 6 in conjunction with FIG. 5, it can be seen that a slide connection mounting system 94 is provided that has a mounting extension 96 that is positioned at the bottom of the cut-out panel 88. The mounting extension 96 presents two opposing lateral arms 98. Each of the lateral arms 98 terminates with a T-head 99. Two loop straps 100 are sewn onto the front surface 74 of the main bag 72 within the protected area 82. The opposing ends 102, 104 of each loop strap 100 are sewn to the main bag 72. Each loop strap 100 is open and unsecured between the opposing ends 102, 104. This creates an open segment 106 of length L3 under each of the loop straps 100. The loop straps 100 are parallel and are spaced apart enough to receive the lateral arms 98 of the T-shaped base 96. The lateral arms 98 of the mounting extension 96 are set into the open segments 106 of the loop straps 100. This enables the cut-out panel 88 to move up and down through a range that is equal to the length L3 of the open segments 106. The presence of the lateral arms 98 in the open segments 106 of the loop straps 54 also enables the cut-out panel 88 to move back and forth across a long arc A1.

There is significant friction between the lateral arms 98, the front surface 74 of the main bag 72 and the loop straps 100. The friction is enough to hold the cut-out panel 88 in place. As a consequence, the cut-out panel 88 can be manually manipulated both up and down and back and forth. If the cut-out panel 88 is released in any position within its adjustable range, the cut-out panel 88 remains in that position. Accordingly, a person has the option to pull the cut-out panel 88 out into a very obvious position or push the cut-out panel 88 into the pocket extension 80, where it is less noticeable.

Referring to FIG. 4 in conjunction with FIG. 5 and FIG. 6, it can be seen that the cut-out panel 88 itself is thin and does not occupy much space within the pocket extension 80. The presence of the cut-out panel 88 in the pocket extension 80 creates a secondary pocket 110 between the front surface 74 of the main bag 72 and the rear surface 92 of the cut-out panel 88. Objects, such as a smart phone or eyeglasses, can be placed into this secondary pocket 110 (FIG. 4). When the cut-out panel 88 is pulled up, any object in the secondary pocket 110 is also pulled up. This can make accessing objects, such as phones, much easier.

A person using the carry bag assembly 70 may not always desire the cut-out panel 88 to be visible. The lateral arms 98 on the cut-out panel 88 are not permanently attached to the loop straps 100. The lateral arms 98 can be manipulated out from behind the loop straps 100. Once disengaged from the loop straps 100, the cut-out panel 88 is separate and distinct from the remainder of the carry bag assembly 70. The cut-out panel 88 is small enough to be placed fully within the main bag 72, wherein the cut-out panel 88 can be carried without being seen.

Figure 7:
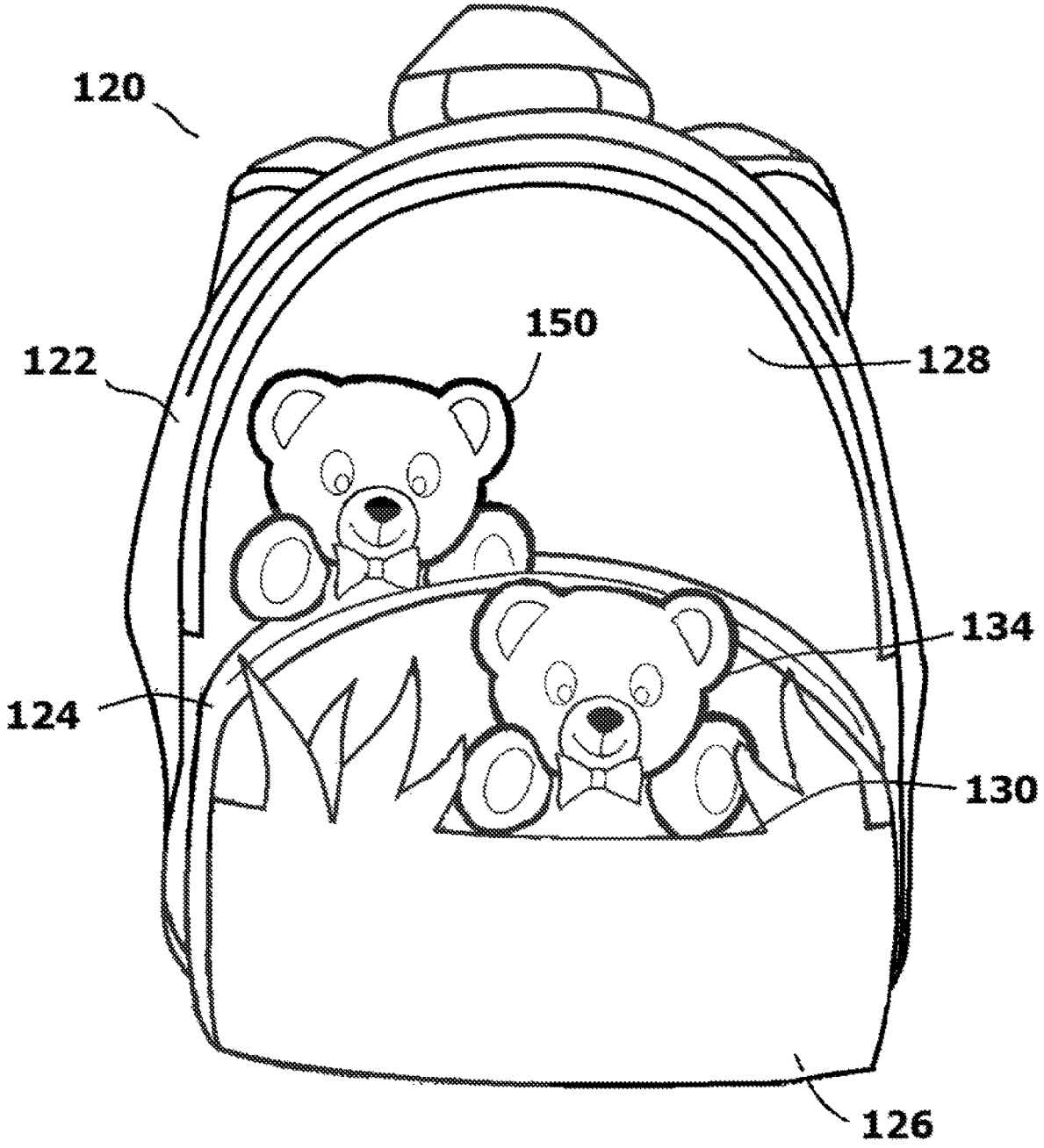
FIG. 7 shows an alternate embodiment of the present invention.
Figure 8:
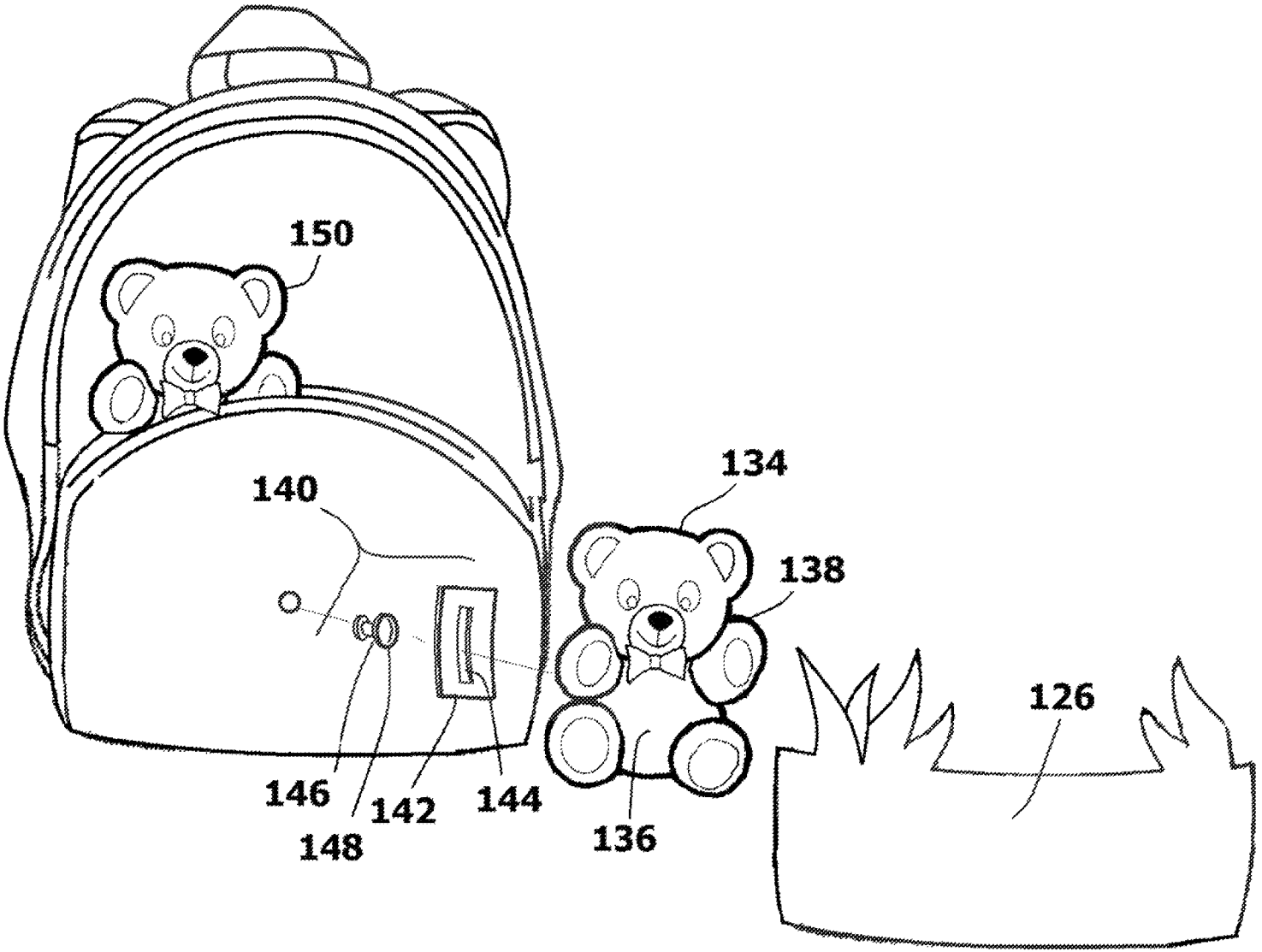
FIG. 8 shows an exploded view of the embodiment of FIG. 7.

Referring to FIG. 7 in conjunction with FIG. 8, an alternate carry bag assembly 120 is shown. In this embodiment, there is a main bag 122 and a secondary bag 124. A pocket extension 126 is provided on a front surface 128 of the secondary bag 124. The pocket extension 126 is highly visible and is themed in a complementary manner with the main bag 122 and the secondary bag 124. The pocket extension 126 has an open top 130 that may or may not contain a zipper closure.

A cut-out panel 134 is provided. The cut-out panel 134 has a front surface 136 and a rear surface 138. The cut-out panel 134 is shaped as a character. Furthermore, at least some of the front surface 136 of the cut-out panel 134 is decorated as the character. The rear surface 138 of the cut-out panel 134 is attached to the secondary bag 124 inside the pocket extension 126. The cut-out panel 134 is attached to the secondary bag 124 with a slot mounting system 140. The slot mounting system 140 enables at least a portion of the cut-out panel 134 to slide up and out of the pocket extension 126 or slide down into the pocket extension 126.

In the shown embodiment, the slot mounting system 140 includes a slotted band 142 that is connected to the rear surface 138 of the cut-out panel 134. The slotted band 142 defines a slot 144. A mechanical connector 146 passes through the slot 144 and engages the secondary bag 124. The mechanical connector 146 has an enlarged head 148 that is wider than the slot 144. When the cut-out panel 134 is grasped and manipulated, the slot 144 moves relative to the mechanical connector 146. This provides the cut-out panel 134 with a range of motion. Accordingly, the cut-out panel 134 can be moved up, down and laterally through a range of motion. Furthermore, with proper manipulation, the slot 144 can be moved around the mechanical connector 146 in the manner of unbuttoning a button. This will separate the cut-out panel 134 from the pocket extension 126. The cut-out panel 134 can then be stored for later use.

The same slot mounting system 140 can also be used to mount a cut-out panel 150 inside the secondary bag 124. The slot mounting system 140 provides the cut-out panel 150 with a range of motion. The range of motion can be large enough that the entirety of the cut-out panel 150 can be retracted into the secondary bag 124, should a person not want the cut-out panel 150 to be seen.

Although FIG. 8 illustrates a single slotted band 142 and slot 144, more than one slotted band and slot may be used in connection with each of one or more cut-out panels 134 in carry bag assembly 120.

It will be understood that the embodiments of the present invention that are illustrated and described are merely exemplary and that a person skilled in the art can make many variations to those embodiments. Features from different embodiments can be mixed and matched in manners not illustrated. All such embodiments are intended to be included within the scope of the present invention as defined by the claims.

What is claimed is:

1. An assembly comprising:

a carry bag having an exterior surface;

a cut-out panel having a front surface and a rear surface;

a mounting system that joins said cut-out panel to said carry bag, wherein said mounting system includes a first mounting strap connected to said carry bag, therein forming a first loop, and a second mounting strap connected to said rear surface of said cut-out panel, therein forming a second loop, wherein said first loop is interlinked with said second loop and enables said cut-out panel to move through a range of motion relative to said carry bag while remaining attached to said carry bag, and wherein at least some of said cut-out panel covers at least some of said exterior surface of said carry bag at some positions within said range of motion.

2. The assembly according to claim 1, wherein said cut-out panel is configured as a character.

3. The assembly according to claim 1, wherein said carry bag has a pocket on said exterior surface, wherein said mounting system joins said cut-out panel to said carry bag within said pocket.

4. The assembly according to claim 3, wherein said range of motion enables at least some of said cut-out panel to extend out of said pocket.

5. The assembly according to claim 4, wherein said range of motion enables all of said cut-out panel to be moved into said pocket.

6. The assembly according to claim 5, wherein said pocket has a closure for sealing said cut-out panel into said pocket.

7. The assembly according to claim 1, wherein said mounting system includes a slot formed in said carry bag and a mechanical connector that extends from said cut-out panel and engages said slot, therein joining said cut-out panel to said carry bag.

8. An assembly comprising:

a carry bag having an exterior surface;

a pocket extension extending from said carry bag, wherein said pocket extension has an interior surface and an access opening;

a cut-out panel having a front surface and a rear surface;

a mounting system that joins said cut-out panel to said interior surface of said pocket extension, wherein said mounting system includes a slot formed in said interior surface of said pocket extension and a mechanical connector that extends from said cut-out panel and engages said slot, therein joining said cut-out panel to said interior surface of said pocket extension and enabling said cut-out panel to move through a range of motion relative said pocket extension, wherein at least some of said cut-out panel extends out of said pocket extension through said access opening when moved through said range of motion.

9. The assembly according to claim 8, wherein said cut-out panel is configured as a character with a theme.

10. The assembly according to claim 9, wherein said exterior surface of said carry bag contains graphics in said theme.

11. The assembly according to claim 8, wherein said range of motion enables all of said cut-out panel to be moved into said pocket.

12. The assembly according to claim 8, wherein said pocket has a closure on said access opening for sealing said cut-out panel into said pocket extension.

13. An assembly comprising:

a carry bag having an exterior surface;

a cut-out panel having a front surface and a rear surface;

a mounting system that joins said cut-out panel to said carry bag, wherein said mounting system includes parallel mounting straps connected to said carry bag, therein forming two loops, wherein an extension extends from said cut-out panel that extends into said loops, therein joining said cut-out panel to said carry bag and enabling said cut-out panel to move through a range of motion relative to said carry bag while remaining attached to said carry bag, and wherein at least some of said cut-out panel covers at least some of said exterior surface of said carry bag at some positions within said range of motion.

* * * * *